US007619525B2

(12) United States Patent
Kwan

(10) Patent No.: US 7,619,525 B2
(45) Date of Patent: Nov. 17, 2009

(54) METHOD AND SYSTEM FOR PROVIDING SECURITY USING RFID TAGGED ITEMS EXITING OR ENTERING A RETAIL ESTABLISHMENT

(75) Inventor: Derek Kwan, Ontario (CA)

(73) Assignee: International Business Machines Corporation, Armonk, NY (US)

( * ) Notice: Subject to any disclaimer, the term of this patent is extended or adjusted under 35 U.S.C. 154(b) by 286 days.

(21) Appl. No.: 11/828,692

(22) Filed: Jul. 26, 2007

(65) Prior Publication Data

US 2008/0088450 A1 Apr. 17, 2008

(30) Foreign Application Priority Data

Oct. 12, 2006 (CA) ..... 2563634

(51) Int. Cl.
*G08B 13/14* (2006.01)

(52) U.S. Cl. ..... 340/572.1; 340/572.4; 340/568.1; 340/571; 235/375

(58) Field of Classification Search ..... 340/572.1, 340/572.4, 568.1, 570, 825.36, 505, 506, 340/521, 522, 528; 235/375, 385, 383
See application file for complete search history.

(56) References Cited

U.S. PATENT DOCUMENTS

| | | | | |
|---|---|---|---|---|
| 5,874,896 | A * | 2/1999 | Lowe et al. | 340/572.1 |
| 6,169,483 | B1 | 1/2001 | Ghaffari et al. | |
| 6,259,369 | B1 | 7/2001 | Monico | |
| 6,486,783 | B1 | 11/2002 | Hausladen et al. | |
| 6,851,617 | B2 | 2/2005 | Saint et al. | |
| 2002/0147649 | A1 | 10/2002 | White | |
| 2003/0006281 | A1 | 1/2003 | Thomas et al. | |
| 2003/0058110 | A1 | 3/2003 | Rich | |
| 2003/0197064 | A1 | 10/2003 | Saint et al. | |

(Continued)

FOREIGN PATENT DOCUMENTS

| | | | |
|---|---|---|---|
| EP | 1130556 | A1 | 9/2001 |

(Continued)

OTHER PUBLICATIONS

Gao et al.; "An Approach to Security and Privacy of RFID System For Supply Chain"; Proceedings of the IEEE International Conference on E-Commerce Technology for Dynamic E-Business (CEC-East'04); 5 pages.

*Primary Examiner*—Toan N Pham
(74) *Attorney, Agent, or Firm*—Schmeiser, Olsen & Watts; William H. Steinberg

(57) ABSTRACT

A method or system of providing security utilizing RFID tagged items exiting or entering a retail establishment. A RFID tag value of a RFID tagged item being checked out is: read by a first RFID reader, added to an exit queue, and read by a second RFID reader at an exit of the retail establishment after which it is ascertained that the RFID tag value is or is not in the exit queue respectively resulting in deletion of the RFID tag value from the exit queue or raising a security alert. A RFID tag value of a first RFID tagged item at an entrance of the retail establishment is read by a RFID reader, added to an entrance queue, determined as having come from the retail establishment, and ascertained to have entered the retail establishment to be returned for a refund or exchanged for a second RFID tagged item.

20 Claims, 6 Drawing Sheets

U.S. PATENT DOCUMENTS

| | | | | |
|---|---|---|---|---|
| 2004/0002906 | A1 | 1/2004 | Von Drehnen et al. | |
| 2004/0044956 | A1 | 3/2004 | Huang | |
| 2004/0056823 | A1 | 3/2004 | Zuk et al. | |
| 2004/0117514 | A1 | 6/2004 | Nelms et al. | |
| 2004/0174257 | A1 | 9/2004 | Kuhns et al. | |
| 2004/0210494 | A1 | 10/2004 | White | |
| 2004/0210495 | A1 | 10/2004 | White | |
| 2005/0073416 | A1* | 4/2005 | Mathewson et al. | 340/572.1 |
| 2005/0131763 | A1 | 6/2005 | Junger | |
| 2006/0044115 | A1 | 3/2006 | Doi et al. | |
| 2006/0163368 | A1 | 7/2006 | Fogg et al. | |
| 2006/0164321 | A1 | 7/2006 | Mathieu et al. | |
| 2007/0046439 | A1* | 3/2007 | Takaku et al. | 340/10.41 |

FOREIGN PATENT DOCUMENTS

| | | | |
|---|---|---|---|
| EP | 1359523 | A1 | 11/2003 |
| EP | 1393927 | A1 | 3/2004 |
| EP | 1433124 | B1 | 10/2005 |
| FR | 2855923 | A1 | 12/2004 |
| JP | 2002319001 | | 10/2002 |
| JP | 2003191668 | A | 7/2003 |
| JP | 2004086901 | A | 3/2004 |
| JP | 2004090099 | A | 3/2004 |
| JP | 2005025412 | A | 1/2005 |
| JP | 2005025722 | A | 1/2005 |
| WO | WO0067221 | | 11/2000 |
| WO | WO0124109 | A1 | 4/2001 |
| WO | WO0225584 | A1 | 3/2002 |
| WO | WO03005295 | A1 | 1/2003 |
| WO | WO03090151 | A2 | 10/2003 |
| WO | WO2004025554 | A1 | 3/2004 |
| WO | WO2004027681 | A2 | 4/2004 |
| WO | WO2004031969 | A2 | 4/2004 |
| WO | WO2004080138 | A1 | 9/2004 |
| WO | WO2004102312 | A2 | 7/2007 |

* cited by examiner

METHOD AND SYSTEM FOR PROVIDING SECURITY USING RFID TAGGED ITEMS EXITING OR ENTERING A RETAIL ESTABLISHMENT

FIELD OF THE INVENTION

The present invention relates to systems and methods for providing security using radio frequency identification (RFID) readers and tags, especially in a retail sales environment.

BACKGROUND OF THE INVENTION

In recent years, RFID tags have been used to track bulk objects such as pallets or boxes of items to help retailers manage the supply chain from their suppliers to their warehouses. As the cost and size of RFID tags decrease, their usage in retail environments is increasing. RFID tags may now be found in individual items, and this has extended the range of supply chain management right to the store shelves. RFID tags may store electronic serial numbers (ESNs), which may allow an individual item to be identified, thereby allowing the tracking of inventory on the shelves and back in the storage room.

Although universal product tags (UPCs) are still predominantly used at point-of-sale (POS) terminals for checkout, it is now possible to use RFID tags to identify the items instead. The RFID tags also offer potential for use in other types of applications, such as security. However, this potential must be balanced with concerns over customer privacy. What is needed is an improved system and method for providing security using RFID, especially in retail environments.

SUMMARY OF THE INVENTION

The present invention provides a method of providing security utilizing radio frequency identification (RFID) tagged items exiting a retail establishment, said retail establishment comprising an exit, at least one checkout counter, a first RFID reader, a second RFID reader, and a processor server comprising a security module that includes an exit queue, said first and second RFID readers being operatively connected to the security module, said security module being configured to respectively add or delete RFID tag values of a RFID tagged item to or from the exit queue upon the RFID tagged item being within a reading range of the first or second RFID reader, said method comprising:

reading a RFID tag value of a RFID tagged item being checked out at a first checkout counter of the at least one checkout counter in a purchasing transaction for the item, said reading the RFID tag value being performed by the first RFID reader;

adding the RFID tag value read by the first RFID reader to the exit queue;

after completion of the purchasing transaction for the item, reading the RFID tag value at the exit by the second RFID reader;

after said reading the RFID tag value by the second RFID reader, ascertaining whether the RFID tag value is in the exit queue;

if said ascertaining ascertains that the RFID tag value is in the exit queue then deleting the RFID tag value from the exit queue, otherwise raising a security alert.

The present invention provides a method of providing security utilizing radio frequency identification (RFID) tagged items entering a retail establishment, said retail establishment comprising an entrance, a RFID reader, and a processor server comprising a security module that includes an entrance queue, said RFID reader being operatively connected to the security module, said security module being configured to add or delete RFID tag values of a RFID tagged item to or from the exit queue upon the RFID tagged item being within a reading range of the RFID reader, said method comprising:

reading a RFID tag value of a first RFID tagged item at the entrance upon the first RFID tagged item entering the retail establishment via the entrance, said reading the RFID tag value being performed by the RFID reader;

adding the RFID tag value read by the RFID reader to the entrance queue;

comparing the RFID tag value read by the RFID reader with a previously stored reference RFID tag value to determine if the first RFID tagged item is recognized as having come from the retail establishment;

determining from said comparing that the first RFID tagged item is recognized as having come from the retail establishment;

ascertaining whether the first RFID tagged item has entered the retail establishment to be returned for a refund or to be exchanged for a second RFID tagged item that differs from the first RFID tagged item;

if said ascertaining ascertains that the first RFID tagged item has entered the retail establishment to be returned for a refund then deleting the RFID tag value from the entrance queue;

if said ascertaining ascertains that the first RFID tagged item has entered the retail establishment to be exchanged for the second RFID tagged item then replacing in the entrance queue the RFID tag value of the first RFID tagged item with a different RFID tag value of the second RFID tagged item.

DETAILED DESCRIPTION OF THE INVENTION

Figure 1:
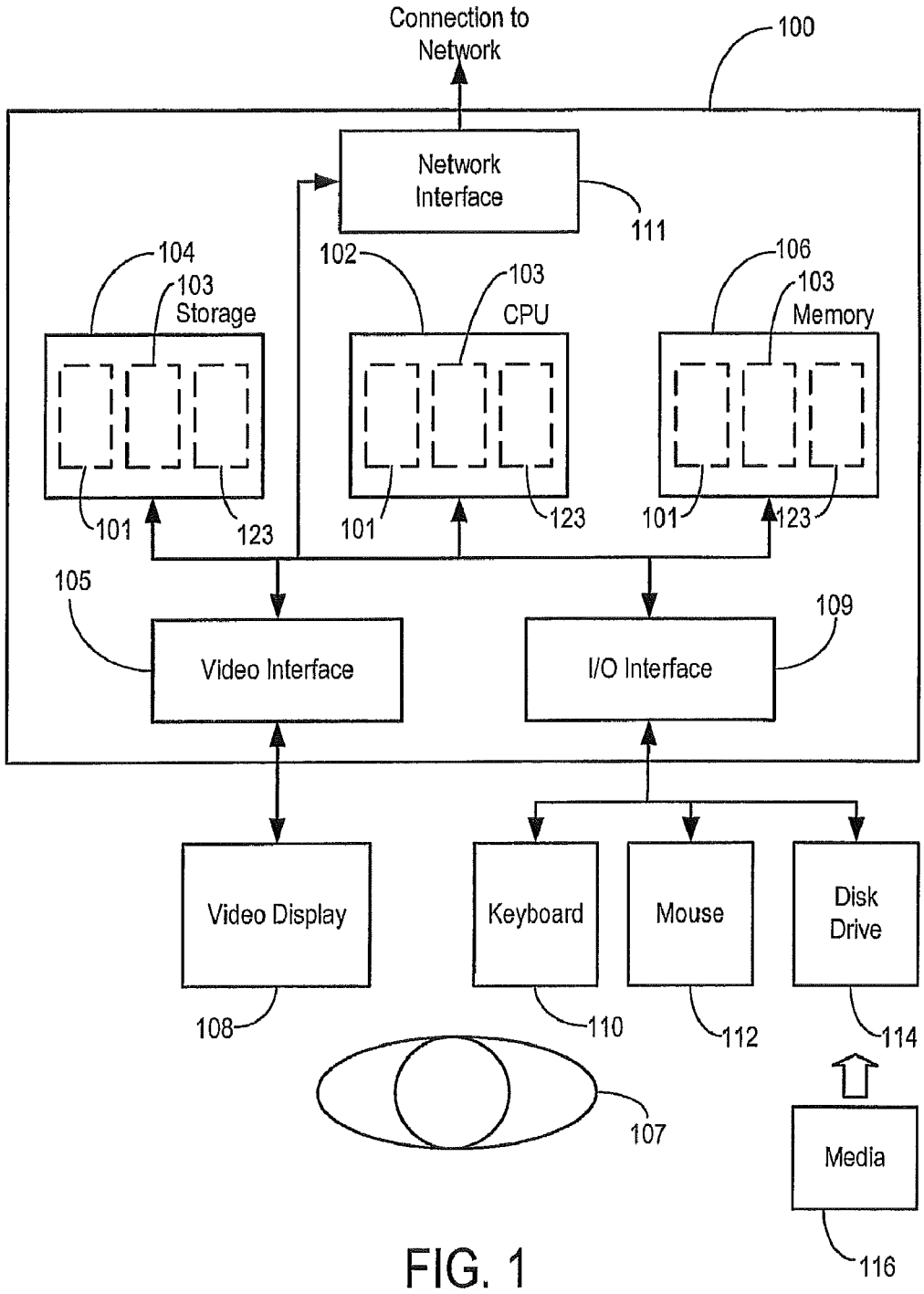
FIG. 1 shows a generic data processing system that may provide a suitable operating environment.

The present invention relates to a system and method for providing security using RFID, especially in retail sales environments.

In an aspect of the invention, there is provided a method of providing security utilizing radio frequency identification (RFID) tagged items, comprising: reading an RFID tag value of an item at a checkout counter utilizing a first RFID reader; adding the read RFID tag value to an exit queue; reading the RFID tag value at an exit utilizing a second RFID reader; and deleting the RFID tag value from the exit queue after the second RFID reader reads the RFID tag value.

In an embodiment, the method further comprises adding the read RFID tag value to the exit queue after completion of a purchasing transaction for the item.

In another embodiment, the method further comprises introducing a delay after the completion of the purchasing transaction for the item, and before the read RFID tag value for the item is added to the exit queue.

In another embodiment, the method further comprises adjusting the delay according to the average duration of time expected between the completion of the purchasing transaction for the item, and the reading of the RFID tag value at the exit.

In another embodiment, the method further comprises raising a security alert if an RFID tag value is detected at the exit without that RFID tag value being stored in the exit queue.

In another embodiment, the method further comprises providing an RFID tag value that is identical for all items of the same kind, unique for each item of the same kind, or randomly selected from a predetermined range of possible values for items of the same kind.

In another embodiment, the method further comprises: reading an RFID tag value of an item at an entrance utilizing a third RFID reader; adding the read RFID tag value to an entrance queue; and comparing the read RFID tag value with a previously stored reference RFID tag value to determine if the item is recognized as having come from the store.

In another embodiment, the method further comprises replacing the RFID tag value in the entrance queue with an RFID tag value for another item provided in exchange.

In another embodiment, the method further comprises deleting the RFID tag value from the entrance queue if the item is returned.

In another aspect of the invention, there is provided a system for providing security utilizing radio frequency identification (RFID) tagged items, the system including a security module configured to: read an RFID tag value of an item at a checkout counter utilizing a first RFID reader; add in an exit queue the read RFID tag value; read an RFID tag value of an item at an exit utilizing a second RFID reader; and delete from the exit queue the RFID tag value after the second RFID reader reads the RFID tag value.

In another embodiment, the security module is further configured to add the RFID tag value to the exit queue only after completion of a purchasing transaction for the item.

In another embodiment, the security module is further configured to introduce a delay after the completion of the purchasing transaction, and before the RFID tag value for the item is added to the exit queue.

In another embodiment, the security module is further configured to adjust the delay according to the average duration of time expected between the completion of the purchasing transaction, and the reading of the RFID tag value at the exit.

In another embodiment, the security module is further configured to raise a security alert if an RFID tag value is detected at the exit without that RFID tag value being stored in the exit queue.

In another embodiment, the security module is further configured to read an RFID tag value that is identical for all items of the same kind, unique for each item of the same kind, or randomly selected from a predetermined range of possible values for items of the same kind.

In another embodiment, the security module is further configured to: read an RFID tag value of an item at an entrance utilizing a third RFID reader; add the read RFID tag value to an entrance queue; compare the read RFID tag value with a previously stored reference RFID tag value to determine if the item is recognized as having come from the store.

In another embodiment, the security module is further configured to replace the RFID tag value in the entrance queue with an RFID tag value for another item provided in exchange.

In another embodiment, the security module is further configured to delete the RFID tag value from the entrance queue if the item is returned.

In another aspect of the invention, there is provided a data processor readable medium storing data processor code that, when loaded into a data processing device, adapts the device to provide security utilizing radio frequency identification (RFID) tagged items, the data processor readable medium comprising: code for reading an RFID tag value of an item at a checkout counter utilizing a first RFID reader; code for adding the read RFID tag value to an exit queue; code for reading the RFID tag value at an exit utilizing a second RFID reader; and code for deleting the RFID tag value from the exit queue after the second RFID reader reads the RFID tag value.

In an embodiment, the data processor readable medium further comprises code for adding the RFID tag value to the exit queue after completion of a purchasing transaction for the item.

In another embodiment, the data processor readable medium further comprises code for introducing a delay after the completion of the purchasing transaction, and before the RFID tag value for the item is added to the exit queue.

In another embodiment, the data processor readable medium further comprises code for adjusting the delay according to the average duration of time expected between the completion of the purchasing transaction, and the reading of the RFID tag value at the exit.

In another embodiment, the data processor readable medium further comprises code for raising a security alert if an RFID tag value is detected at the exit without that RFID tag value being stored in the exit queue.

In another embodiment, the data processor readable medium further comprises code for reading an RFID tag value of an item at an entrance utilizing a third RFID reader; code for adding the read RFID tag value to an entrance queue; and code for comparing the read RFID tag value with a previously stored reference RFID tag value to determine if the item is recognized as having come from the store.

In another embodiment, the data processor readable medium further comprises code for replacing the RFID tag value in the entrance queue with an RFID tag value for another item provided in exchange.

In another embodiment, the data processor readable medium further comprises code for deleting the RFID tag value from the entrance queue if the item is returned.

As noted above, the present invention relates to a system and method for providing security using RFID, especially in retail sales environments.

The invention may be practiced in various embodiments. A suitably configured data processing system, and associated communications networks, devices, software and firmware may provide a platform for enabling one or more of these systems and methods. By way of example, FIG. 1 shows a generic data processing system 100 that may include a central processing unit ("CPU") 102 connected to a storage unit 104 and to a random access memory 106. The CPU 102 may process an operating system 101, application program 103, and data 123. The operating system 101, application program 103, and data 123 may be stored in storage unit 104 and loaded into memory 106, as may be required. An operator 107 may interact with the data processing system 100 using a video display 108 connected by a video interface 105, and various input/output devices such as a keyboard 110, mouse 112, and disk drive 114 connected by an I/O interface 109. In known manner, the mouse 112 may be configured to control movement of a cursor in the video display 108, and to operate various graphical user interface ("GUI") controls appearing in the video display 108 with a mouse button. The disk drive 114 may be configured to accept data processing system readable media 116. The data processing system 100 may form part of a network via a network interface 111, allowing the data processing system 100 to communicate with other suitably configured data processing systems (not shown). The particular configurations shown by way of example in this specification are not meant to be limiting.

Figure 2:
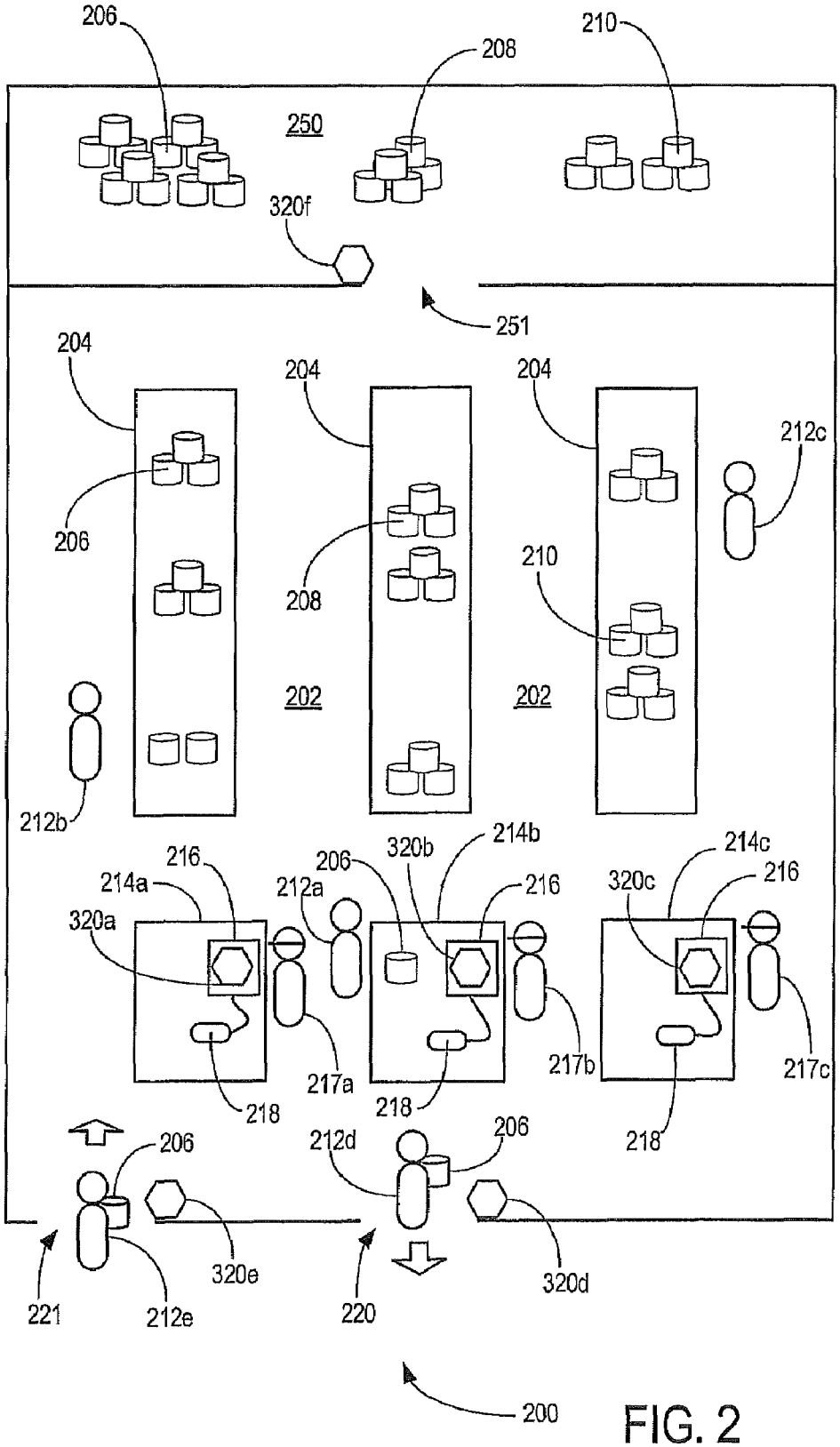
FIG. 2 shows an illustrative retail RFID environment.

Now referring to FIG. 2, shown is an illustrative retail RFID environment 200. As shown, retail RFID environment 200 may include a store floor 202 with shelves 204, holding various items 206, 208, 210. Additional items 206, 208, 210 may be stored in a storage area 250 accessible via a storage room access 251 in order to replenish items 206, 208, 210 on the store shelves 204 when customers 212*a*, 212*b*, 212*c* (collectively customers 212) pick the items 206, 208, 210 up for purchase. Items 206, 208, 210 may include conventional UPC labels, and may further include RFID tags in various configurations as will be explained in more detail further below with reference to FIGS. 3A to 3C.

Still referring to FIG. 2, checkout counters 214*a*, 214*b*, 214*c* may be provided near the store exit 220 so that customers 212 may pay for their purchases. While the exit 220 may be configured to also serve as an entrance, a separate entrance 221 may be provided. Checkout counters 214*a*, 214*b*, 214*c* (collectively checkout counters 214) may have POS terminals 216 that may be attended by cashiers 217*a*, 217*b*, 217*c*. POS terminals 216 may be suitably configured data processing systems (e.g. data processing system 100 or selected components thereof) that may communicate with a back-end data processing system (e.g. another data processing system 100 configured as a server) over a network (not shown).

As shown, POS terminals 216 may also be configured with optical readers 218 for reading UPC labels on items 206, 208, 210. POS terminals 216 may further be configured with RFID readers 320*a*, 320*b*, 320*c* (collectively RFID readers 320) for sensing RFID tags. In an alternative configuration, if checkout counters 214*a*, 214*b*, 214*c* are configured as self-serve checkout stations, then cashiers 217*a*, 217*b*, 217*c* need not be present.

In an embodiment, another RFID reader 320*d* may be provided near the store exit 220 to detect items 206, 208, 210 as they pass by. Other RFID readers may be provided in various locations, such as at the store entrance 221 (RFID reader 320*e*), and at the storage room access 251 (RFID reader 320*f*).

Figure 3A:
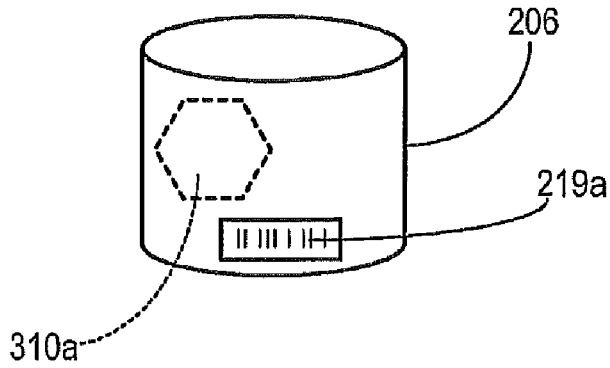
FIGS. 3A to 3C show illustrative items with RFID tags.
Figure 3B:
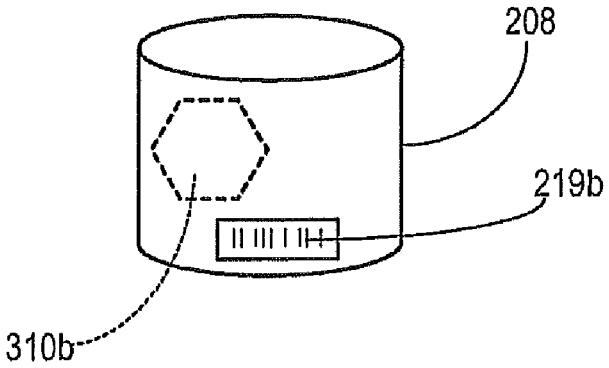
Figure 3C:
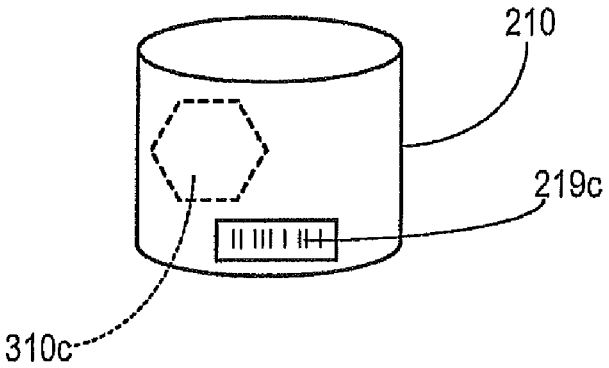

Now referring to FIGS. 3A to 3C, shown are illustrative items 206, 208, 210 having RFID tags 310*a*, 310*b*, 310*c* (collectively RFID tags 310). As shown, each of the items 206, 208, 210 may also include UPC labels 219*a*, 219*b*, 219*c* (collectively UPC labels 219) which may be read by the optical readers 218 shown in FIG. 2. In conventional manner, items 206, 208, 210 may be identified by these UPC labels 219 for the purposes of retrieving pricing information and calculating a total bill for a customer's purchases. Alternatively, items 206, 208, 210 may be tracked at the checkout counters 214 via their RFID tags 310*a*, 310*b*, 310*c*.

For the purposes of the present discussion, consider that each item 206, 208, 210 may include RFID tags 310*a*, 310*b*, 310*c* that may be configured differently. For example, item 206 may include an RFID tag 310*a* with a value that is common to all items 206. That is, RFID tag 310*a* may provide no more information than a UPC label 219 that is common to all items 206. In this case, the RFID tag 310*a* may be used in lieu of the UPC label 219 for the purposes of retrieving pricing information, but does not link a particular item 206 to a particular customer (e.g. to customer 212*a*).

Now consider item 208 which may include an RFID tag 310*b* that includes a value that is unique to that particular item 208 (e.g. a unique electronic serial number or ESN). In this case, if this RFID tag 310*b* is read by an RFID reader 320 at a checkout counter 214, it is possible to link a particular item 208 to a particular customer if the customer is using some form of debit/credit/rewards card. This may provide the highest level of security by linking a particular item to a particular client, but it may also raise some privacy issues.

Finally, consider item 210 which may include an RFID tag 310*c* that includes a random value, but which is not unique. As an example, consider a factory production volume of ten million pieces for item 210, and a shipment to a particular store containing about 10,000 pieces of item 210. Suppose that, at one time, there is no more than 1,000 pieces of item 210 that may be on the store floor 202. In this case, a predetermined range of 3 digits (e.g. from 000 to 999) randomly assigned to items 210 may be enough. There may then be approximately a 1/1000 chance a shoplifter may pick up an item that has the same RFID tag value as another item stored in an exit queue when purchased (as will be explained further below). In a random sample of 1000 items, there will be some chance of having items 210 with duplicated RFID tag values on the floor 202. However, the actual number of items that pass through checkout and toward the exit 220 may only be several items an hour. Thus, the risk would be minimal. While this approach provides an enhanced level of security, a level of anonymity is also provided to customers based on the randomness of the RFID tag values.

Figure 4:
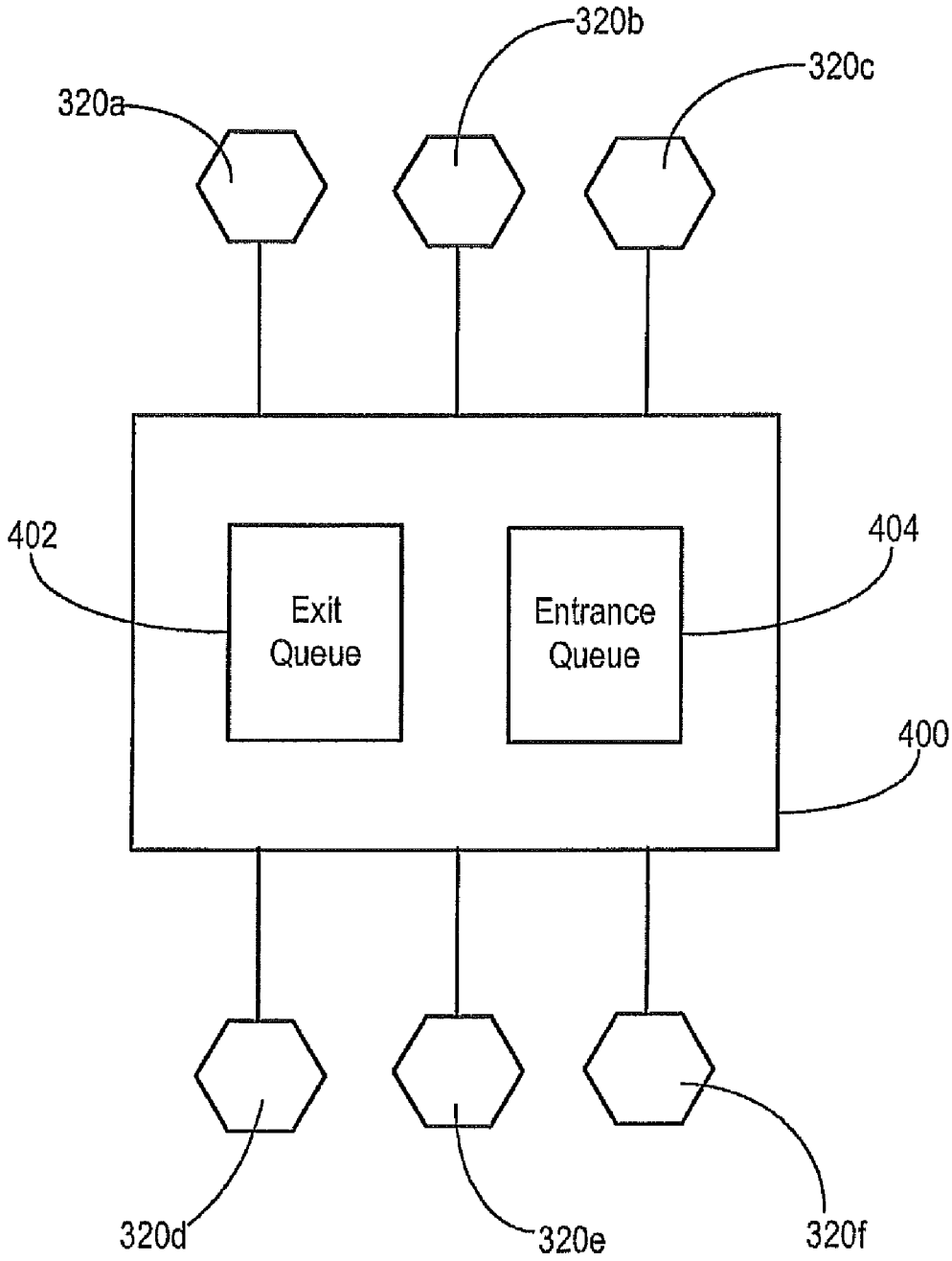
FIG. 4 shows an illustrative security system in accordance with an embodiment.

Now referring to FIG. 4, shown is an illustrative security module 400, which may be embodied in a back-end data processor server (such as an appropriately configured data processor 100 of FIG. 1). As shown in FIG. 4, security module 400 may include queues 402 and 404. Security module 400 may also be operatively connected to each RFID reader 320*a*, 320*b*, 320*c* provided at the checkout counters 214*a*, 214*b*, 214*c*, respectively, and also to RFID reader 320*d* provided at the exit 220. Furthermore, RFID reader 320*e* provided at the entrance 221, and RFID reader 320*f* may also linked to security module 400. Security module 400 may be configured to add or delete items from the queues 402, 404 as items 206, 208, 210 pass by within the reading range of certain RFID readers 320.

As will now be explained by reference to some examples The various configurations for the RFID tags 310*a*, 310*b*, 310*c* as described above, may provide a user of queuing system 400 with significant flexibility in balancing security and customer privacy in a retail environment.

As a first example, consider a customer 212*a* that is purchasing an item 206 having an RFID tag 310*a* at checkout counter 214*b*. In this example, the RFID tag 310*a* carries only the equivalent of a UPC label for each item, and does not contain any uniquely identifiable information. When customer 212*a* is checking out item 206 at a checkout counter 214*b*, only the equivalent of UPC information will be read by the RFID reader 320.

At the checkout counter 214*b*, the RFID tag 310*a* in item 206 may be scanned by RFID reader 320*a* and the identifying value may be used to retrieve pricing information for item 206. Once scanned, item 206 may be added to an exit queue 402 by security module 400. In an embodiment, this exit queue 402 may contain items that have been paid for, but which have not yet left the store. As a customer 212*a* leaves the store (e.g. as shown by the position of customer 212*d*), item 206 with RFID tag 310*a* may be detected at the exit 220 by RFID reader 320*d*, and may be removed from the exit queue 402. If an item 206 is detected at the exit 220 but is not in the exit queue 402, this condition may be interpreted as a possible theft condition, and an alarm may be triggered.

However, in this example, there is a chance that a legitimate customer may trigger an alarm condition if someone else removes the same item 206 from the store floor 202 after customer 212*a* has completed payment but before customer 212*a* has exited the store.

To reduce the possibility of this false alarm condition, in an embodiment, a suitable delay may be introduced after the purchasing transaction is completed and before the purchased item(s) is/are added to exit queue 402. For example, if it will take an average of ten seconds before a customer 212*a* can leave the checkout counter 214*b* to reach the nearest exit 220, then a suitable time delay may be added (e.g. seven or eight seconds).

In an embodiment, in order to account for the variable distance between each checkout counter 214*a*, 214*b*, 214*c* and the exit 220, a variable delay may be added depending on which checkout counter 214*a*, 214*b*, 214*c* a customer is leaving from to reach the exit 220.

In another embodiment, a time-to-live (TTL) interval can be added before items are added to exit queue 402 to cover a situation where RFID tag 310*a* is not detected at the exit 220 within a reasonable amount of time. For example, if an item 206 is not detected by RFID reader 320*d* at exit 220 within 15 minutes, the item 206 may be cleared from the exit queue 402. As another example, the entire exit queue 402 may be cleared as the store closes for the day.

In yet another example, the item being purchased may be item 210, with each RFID tag 310*c* storing a random, but not unique, string. Preferably, the random range of the string should be sufficient to identify each item at one time (in the queue for example) but not unique enough to identify each item in a shipment, for example. This may provide a more reasonable balance between security and customer privacy. With this embodiment, false alarm conditions may be further reduced, as the item 210 will have a random, although not unique, ID string. With a sufficient random range (e.g. a value of between 000 and 999), the likelihood of someone removing an item 210 that has the same random string will be remote.

Figure 5:
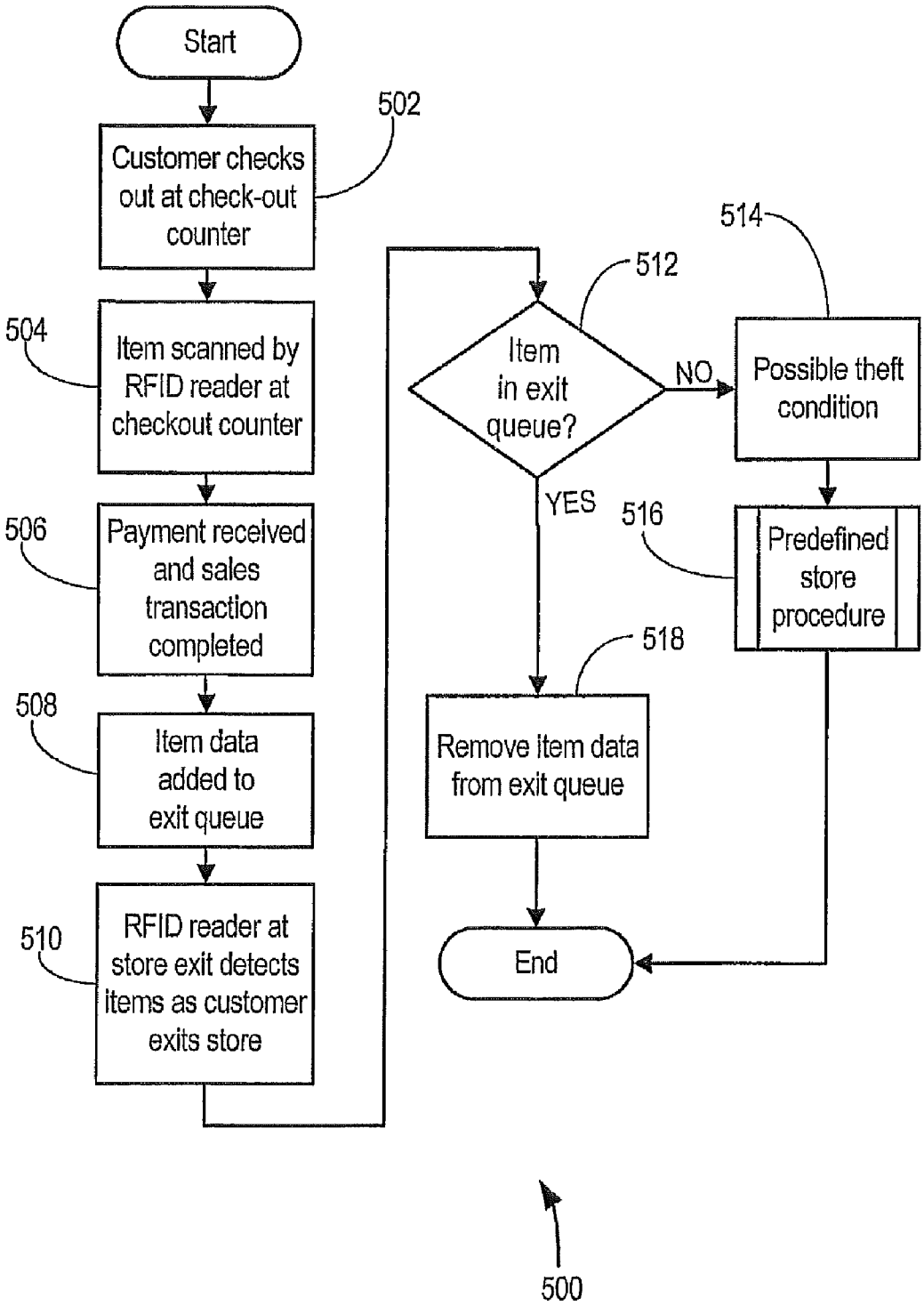
FIG. 5 shows a flowchart of an illustrative sales method in accordance with an embodiment.

Now referring to FIG. 5, shown is a flowchart of an illustrative sales method 500, as may be embodied and practiced in security module 400 of FIG. 4. Method 500 begins at block 502, as a customer (e.g. customer 212*a*) checks out at a checkout counter (e.g. checkout counter 214*b*). At block 504, an item (e.g. item 206) is scanned by an RFID reader (e.g. RFID reader 320*b*). At block 506, payment for the item is received, and the sales transaction is completed at the checkout counter 214*b*.

Next, at block 508, method 508 adds item data to a queue (e.g. exit queue 402), containing the RFID value read at the checkout counter 214*b*. As noted earlier, an appropriate delay may be introduced before item data is added to the exit queue 402 in order to reduce the likelihood of a potential false alarm condition.

Method 500 then proceeds to block 510 where another RFID reader (e.g. RFID reader 320*d*) reads an RFID tag (e.g. RFID tag 310*a*) in the item 206. Method 500 then proceeds to decision block 512 where method 500 determines if the predetermined delay has been reached. If yes, method 500 proceeds directly to block 518, where method 500 removes the data for item 206 from exit queue 402.

If no, method 500 proceeds to block 514, where method 500 may alert security of a possible theft condition. Method 500 may then proceed to block 516, where the store's predefined procedure for investigating the possible theft condition may be implemented to determine if there may be a theft, or a false alarm. Method 500 then ends.

In another embodiment, RFID reader 320*e* at the entrance 221 can be used to detect when an item is being returned to the store (e.g. for a refund or exchange) by a returning customer 212*e*. As shown in FIG. 4, security module 400 may be configured to handle items returning to the store using an entrance queue 404.

As an item is returned to the store, the RFID tag (310*a*, 310*b*, or 310*c*) on the returning item may determine how much information may be retrieved. For example, if the returning item is item 206 with common values for all RFID tags 310*a*, no further information may be retrieved as to the identity of the returning customer 212*e*.

In contrast, if the returning item is item 208 with an ESN that is linked to customer information and uniquely identifies the customer 212*e* who purchased it, then specific information about that item may be retrieved (e.g. what date the item 208 was purchased, and whether the return is being attempted within the allowable return period). With this level of information, the store may be able to determine if a return is being attempted outside of the allowable return period, for example, or if an entirely different item 208 is being returned. It will be appreciated that this may allow the store to more effectively manage and enforce its return policy, and avoid accepting inappropriate returns. However, this may raise some privacy issues.

In another embodiment, if the item being returned is item 210 with a random but not unique value, the item 210 cannot be uniquely identified and linked to a particular customer 212*e*. However, if the random but unique value is linked to the original purchasing transaction (e.g. via a reference number on the receipt), then if someone is trying to return a different item, the likelihood of detecting this may be relatively high given the relatively low probability of having items with the same random value.

Figure 6:
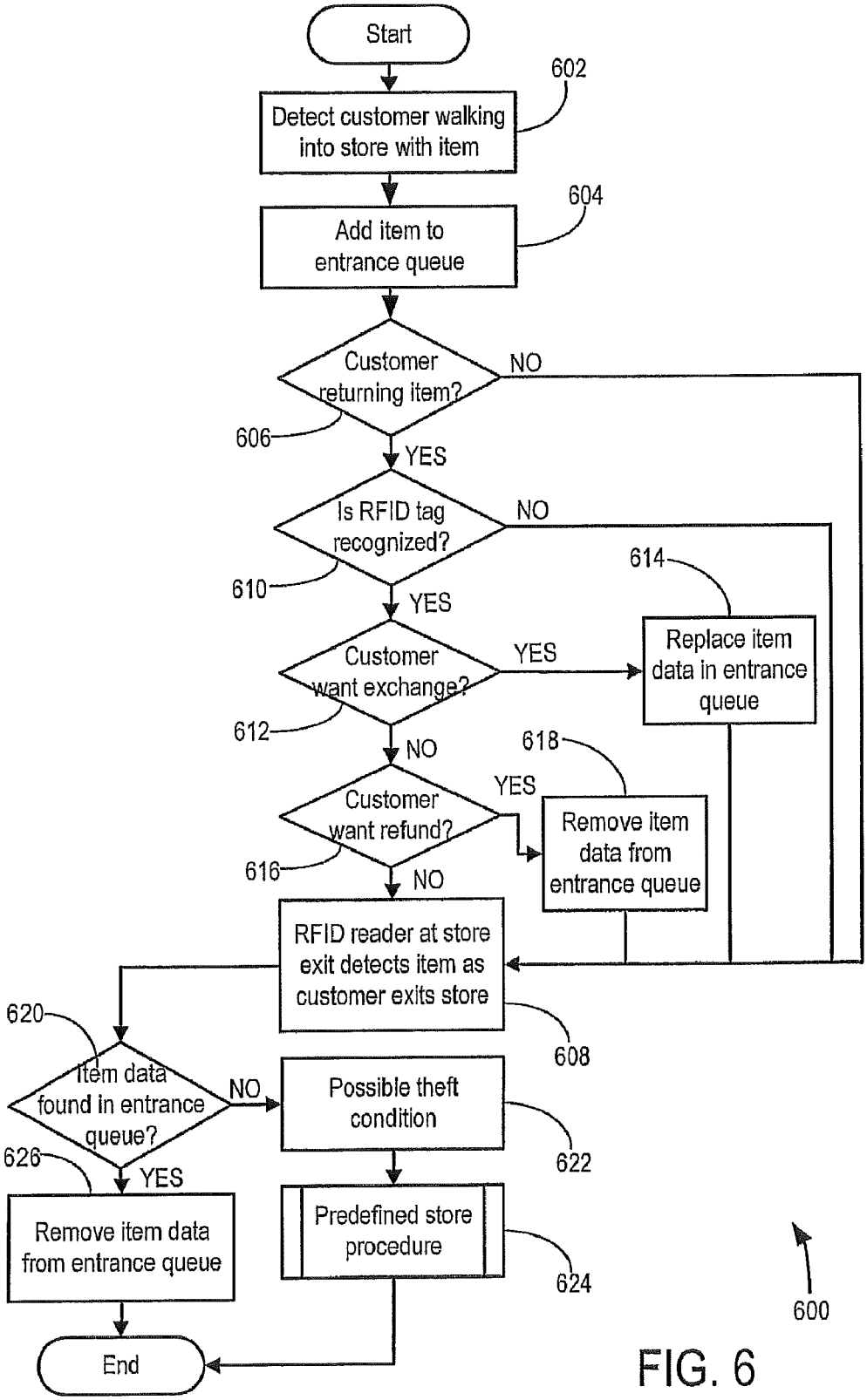
FIG. 6 shows a flowchart of an illustrative refund/exchange method in accordance with an embodiment.

A flowchart of an illustrative refund/exchange method 600 as may be embodied and practiced in security module 400 (FIG. 4) is now shown in FIG. 6. Method 600 starts and at block 602 detects a customer walking into the store with an item 206 (e.g., by detecting RFID tag 310*a* in item 206 as customer 212*e* passes RFID reader 320*e* at store entrance 221).

Method 600 then proceeds to block 604, where item data for item 206 is added to an entrance queue (e.g. entrance queue 404). Method 600 then proceeds to decision block 606, where method 600 determines if a customer is trying to return an item 206 by comparing the RFID tag value of the detected RFID tag 310*a* with a previously stored reference RFID tag value to determine if the item 206 is recognized as having come from the store. If no, method 600 may proceed to block 608. If yes, method 600 may proceed to decision block 610 to determine if the RFID tag can be recognized as one that may have come from the store. If no, method 600 proceeds to block 608. If yes, method 600 proceeds to decision block 612.

At decision block 612, method 600 tries to determine if the item has been returned for an exchange. If yes, method 600 proceeds to block 614, where the data for item 206 in entrance queue 404 may be replaced with another item (perhaps having a different RFID tag value). If no, method 600 proceeds to decision block 616, where method 600 tries to determine if the item has been returned for a refund. If yes, method 600 proceeds to block 618, where data for item 206 is removed from entrance queue 404. If no, method 600 proceeds to block 608, where RFID reader 320*d* may pick up the RFID tag value of item 206 as the customer re-exits the store at exit.

Method 600 then proceeds to decision block 620, where method 600 may determine if data for item 206 is found in the entrance queue 404. If yes, method 600 proceeds to block 626, where data for item 206 is removed from the entrance queue 404.

If no, method 600 proceeds to block 622, where method 600 may alert store security to a possible theft condition. Method 600 then proceeds to block 624, where predetermined store procedures for investigating a possible theft condition may be followed. Method 600 then ends.

While particular embodiments of the present invention have been described herein for purposes of illustration, many modifications and changes will become apparent to those skilled in the art. Accordingly, the appended claims are intended to encompass all such modifications and changes as fall within the true spirit and scope of this invention.

What is claimed is:

1. A method of providing security utilizing radio frequency identification (RFID) tagged items exiting a retail establishment, said retail establishment comprising an exit, at least one checkout counter, a first RFID reader, a second RFID reader, and a processor server comprising a security module that includes an exit queue, said first and second RFID readers being operatively connected to the security module, said security module being configured to respectively add or delete RFID tag values of a RFID tagged item to or from the exit queue upon the RFID tagged item being within a reading range of the first or second RFID reader, said method comprising:

reading a RFID tag value of a RFID tagged item being checked out at a first checkout counter of the at least one checkout counter in a purchasing transaction for the item, said reading the RFID tag value being performed by the first RFID reader;

adding the RFID tag value read by the first RFID reader to the exit queue;

after completion of the purchasing transaction for the item, reading the RFID tag value at the exit by the second RFID reader;

after said reading the RFID tag value by the second RFID reader, ascertaining whether the RFID tag value is in the exit queue;

if said ascertaining ascertains that the RFID tag value is in the exit queue then deleting the RFID tag value from the exit queue, otherwise raising a security alert.

2. The method of claim 1, wherein said ascertaining ascertains that the RFID tag value is in the exit queue.

3. The method of claim 1, wherein said ascertaining ascertains that the RFID tag value is not in the exit queue.

4. The method of claim 1, wherein said adding the RFID tag value read by the first RFID reader to the exit queue is performed after said completion of the purchasing transaction for the item.

5. The method of claim 4, said method further comprising introducing a time delay after said completion of the purchasing transaction for the item and before said adding the RFID tag value read by the first RFID reader to the exit queue.

6. The method of claim 5, wherein the time delay is less than an average duration of time expected for a customer to leave the first checkout counter and arrive at the exit.

7. The method of claim 6, wherein the at least one checkout counter consists of a plurality of checkout counters, and the method further comprises:

prior to said introducing the time delay, computing the time delay in consideration of a distance between the first checkout counter and the exit.

8. The method of claim 1, wherein the RFID tag value of the RFID tagged item and the RFID tag value for all other RFID tagged items in the retail establishment which are the same as the RFID tagged item are a same RFID tag value.

9. The method of claim 1, wherein the RFID tag value of the RFID tagged item is unique to the RFID tagged item with respect to all other RFID tagged items in the retail establishment.

10. The method of claim 1, wherein the RFID tag value of the RFID tagged item comprises a random number randomly selected from a specified range of numbers, and wherein all other RFID tagged items in the retail establishment which are the same as the RFID tagged item likewise comprise a random number randomly selected from the specified range of numbers.

11. A system comprising at least one processing unit and at least one computer readable memory unit coupled to the at least one processor, said at least one memory unit containing program code that when executed by the at least one processing unit implement the method of claim 1, wherein the system comprises the processor server, the first RFID reader, and the second RFID reader.

12. A computer program product, comprising a computer usable storage media having computer readable program code stored thereon, wherein the program code when executed on the at least one processor performs the method of claim 1.

13. A method of providing security utilizing radio frequency identification (RFID) tagged items entering a retail establishment, said retail establishment comprising an entrance, a RFID reader, and a processor server comprising a security module that includes an entrance queue, said RFID reader being operatively connected to the security module, said security module being configured to add or delete RFID tag values of a RFID tagged item to or from the exit queue upon the RFID tagged item being within a reading range of the RFID reader, said method comprising:

reading a RFID tag value of a first RFID tagged item at the entrance upon the first RFID tagged item entering the retail establishment via the entrance, said reading the RFID tag value being performed by the RFID reader;

adding the RFID tag value read by the RFID reader to the entrance queue;

comparing the RFID tag value read by the RFID reader with a previously stored reference RFID tag value to determine if the first RFID tagged item is recognized as having come from the retail establishment;

determining from said comparing that the first RFID tagged item is recognized as having come from the retail establishment;

ascertaining whether the first RFID tagged item has entered the retail establishment to be returned for a refund or to be exchanged for a second RFID tagged item that differs from the first RFID tagged item;

if said ascertaining ascertains that the first RFID tagged item has entered the retail establishment to be returned for a refund then deleting the RFID tag value from the entrance queue;

if said ascertaining ascertains that the first RFID tagged item has entered the retail establishment to be exchanged for the second RFID tagged item then replacing in the entrance queue the RFID tag value of the first RFID tagged item with a different RFID tag value of the second RFID tagged item.

14. The method of claim 13, wherein said ascertaining ascertains that the first RFID tagged item has entered the retail establishment to be returned for the refund.

15. The method of claim 13, wherein said ascertaining ascertains that the first RFID tagged item has entered the retail establishment to be exchanged for the second RFID tagged item.

16. The method of claim 13, wherein the first RFID tag value of the first RFID tagged item and the RFID tag value for all other RFID tagged items in the retail establishment which are the same as the first RFID tagged item are a same RFID tag value.

17. The method of claim 13, wherein the first RFID tag value of the first RFID tagged item is unique to the first RFID tagged item with respect to all other RFID tagged items in the retail establishment.

18. The method of claim 13, wherein the first RFID tag value of the first RFID tagged item comprises a random number randomly selected from a specified range of numbers, and wherein all other RFID tagged items in the retail establishment which are the same as the first RFID tagged item likewise comprise a random number randomly selected from the specified range of numbers.

19. A system comprising at least one processing unit and at least one computer readable memory unit coupled to the at least one processor, said at least one memory unit containing program code that when executed by the at least one processing unit implement the method of claim 13, wherein the system comprises the processor server and the RFID reader.

20. A computer program product, comprising a computer usable storage media having computer readable program code stored thereon, wherein the program code when executed on the at least one processor performs the method of claim 13.

* * * * *